US007695067B2

(12) United States Patent
Goetz et al.

(10) Patent No.: US 7,695,067 B2
(45) Date of Patent: Apr. 13, 2010

(54) ERGONOMIC ADJUSTABLE CHAIR

(76) Inventors: Mark W. Goetz, 231 Washington St., Brooklyn, NY (US) 11205; Michael R. Kerschbaumer, 56 Thomas Drive, Collingwood, Ontario (CA) L9Y 0A6

( * ) Notice: Subject to any disclaimer, the term of this patent is extended or adjusted under 35 U.S.C. 154(b) by 310 days.

(21) Appl. No.: 11/713,145

(22) Filed: Mar. 2, 2007

(65) Prior Publication Data

US 2008/0211277 A1 Sep. 4, 2008

(51) Int. Cl.
*A47C 7/46* (2006.01)

(52) U.S. Cl. ..... 297/284.8; 297/284.1; 297/284.4

(58) Field of Classification Search .... 297/284.1–284.8
See application file for complete search history.

(56) References Cited

U.S. PATENT DOCUMENTS

| | | | | |
|---|---|---|---|---|
| 3,224,808 | A * | 12/1965 | Spielman | 297/341 |
| 4,502,729 | A | 3/1985 | Locher | |
| 4,529,247 | A | 7/1985 | Stumpf et al. | |
| 4,776,633 | A | 10/1988 | Knoblock et al. | |
| 4,804,227 | A | 2/1989 | Hansen | |
| 4,889,385 | A | 12/1989 | Chadwick et al. | |
| 5,024,484 | A | 6/1991 | Buchacz | |
| 5,035,466 | A | 7/1991 | Mathews et al. | |
| 5,100,201 | A | 3/1992 | Becker, III et al. | |
| 5,195,801 | A | 3/1993 | Franck et al. | |
| 5,320,410 | A | 6/1994 | Faiks et al. | |
| 5,486,035 | A | 1/1996 | Koepke et al. | |
| 5,558,399 | A | 9/1996 | Serber | |
| 5,711,575 | A | 1/1998 | Hand et al. | |
| 5,772,282 | A | 6/1998 | Stumpf et al. | |
| 5,909,923 | A | 6/1999 | DeKraker | |
| 6,386,634 | B1 | 5/2002 | Stumpf et al. | |
| 6,533,352 | B1 | 3/2003 | Glass et al. | |
| 6,616,228 | B2 * | 9/2003 | Heidmann | 297/284.4 |
| 6,702,390 | B2 | 3/2004 | Stumpf et al. | |
| 6,733,080 | B2 | 5/2004 | Stumpf et al. | |
| 6,749,261 | B2 * | 6/2004 | Peterson et al. | 297/284.4 |
| 6,805,405 | B2 * | 10/2004 | Koo | 297/284.7 |
| 6,869,142 | B2 | 3/2005 | Heidmann et al. | |
| 6,945,605 | B2 | 9/2005 | Kinoshita et al. | |
| 6,966,604 | B2 | 11/2005 | Stumpf et al. | |
| 6,991,291 | B2 | 1/2006 | Knoblock et al. | |
| 7,029,071 | B2 | 4/2006 | Watson et al. | |
| 7,118,176 | B2 | 10/2006 | Erker | |

(Continued)

FOREIGN PATENT DOCUMENTS

| | | |
|---|---|---|
| JP | 02046811 | 8/1989 |

(Continued)

*Primary Examiner*—Laurie K Cranmer
(74) *Attorney, Agent, or Firm*—K&L Gates LLP

(57) ABSTRACT

A chair mechanism for an ergonomically adjustable, reclinable chair includes a frame and profile bands mounted to the frame. The profile bands are flexible and are configured to define a forwardly projecting lumbar region, the degree of forward projection of the lumbar region being variable in response to the position and movement of the chair seat. A flexible back support surface is carried by and spans the region between the profile bands. The shape and contour of the back surface is controlled by the shape of the profile bands. The chair mechanism enables the user to shift easily between upright and reclining positions without requiring the use of heavy springs or complex linkages.

27 Claims, 17 Drawing Sheets

U.S. PATENT DOCUMENTS

| | | | | |
|---|---|---|---|---|
| 2004/0245840 | A1 | 12/2004 | Tubergen et al. | |
| 2005/0029849 | A1 | 2/2005 | Goetz et al. | |
| 2005/0275264 | A1 * | 12/2005 | Norman et al. | 297/284.4 |
| 2006/0175884 | A1 | 8/2006 | Jenkins | |
| 2007/0080570 | A1 * | 4/2007 | Kohl et al. | 297/284.4 |
| 2008/0179930 | A1 * | 7/2008 | Harley | 297/284.7 |

FOREIGN PATENT DOCUMENTS

| | | |
|---|---|---|
| JP | 2002119367 | 4/2002 |
| WO | WO 2005/039361 | 5/2005 |

* cited by examiner

ERGONOMIC ADJUSTABLE CHAIR

FIELD OF THE INVENTION

The invention relates to ergonomic adjustable chairs, including reclinable task chairs.

BACKGROUND OF THE INVENTION

Task chairs, commonly found in office and other work environments, typically include an arrangement to enable the sitter to adjust his posture between upright and reclined positions. It has been observed, reportedly, that one sitting at a desk or other work space may shift posture or position within the chair as often as approximately once per minute. Desirably, such chairs should be comfortable throughout the range of user-shifted positions. Movement through the range of chair movement should require little effort. The chair should present even resistance to the user's movement and should avoid a sense of instability. The resistance should be low and as close to uniform, as sensed by the user, as possible. The chair, desirably, should require no effort by the user to maintain the chair in a selected reclined position. This quality, referred to as "dwell" may be considered as the ability of the chair to maintain a balanced position at any attitude within the recline range of the chair.

Task chairs having a reclining feature require a number of considerations in order to facilitate comfort, reduce stress and minimize user effort when changing positions. Reclinable chairs may take any of a number of general configurations, including those in which the entire chair, including the seat and back, tilt back, as well as those in which the seat back and seat of the chair are mounted to a frame so that they can move relative to each other.

A common feature of reclinable or tiltable chairs is a spring mechanism to bias the chair components toward an upright position. These mechanisms typically include powerful springs to generate sufficient force to reduce the effort of the sitter when shifting between reclined and upright positions. The spring mechanisms are designed to apply a progressively increasing resistance force as the user reclines in order to counteract the increase in load supported by the back of the chair. The spring force stored during recline serves to assist the user when returning to an upright position. The use of such spring mechanisms generally results in variation in the force necessary to shift the degree of incline at various portions of the range of movement of the chair resulting in an uneven resistance and feeling of instability. In those chairs having separately movable seat and back portions, complex linkages and pivots may be used in an effort to optimize the motion of the chair components between upright and reclining positions that will be comfortable and will provide desired degree of support for the user throughout the range of motion.

Chairs having such spring and linkage mechanisms typically are complex and difficult to design and assemble. Additionally, they tend to be costly. The spring and linkage mechanisms for such chairs typically are among the most expensive of the chair components.

Also among the difficulties with those reclinable or tiltable chairs having a spring mechanism to bias the chair in the upright position is that the force applied by the spring must be adjusted or tuned for the particular user. Larger, heavier users will require an adjustment to increase the force of the spring while smaller, lighter users will require adjustment to a reduced spring force. This may be problematic in shared use environments, such as conference rooms, where a particular chair may be used by different users at different times or where the user may not be familiar with the adjustment controls of the chair. Even where a chair is dedicated for a single user, the adjustment and tuning mechanisms may not be understood and the user may be unable to or may find it difficult to adjust the chair.

Such chairs may be provided with some form of lumbar support intended to relieve spinal stress and back fatigue by bearing against the lumbar region of the back, particularly when the user is sitting in an upright position in which the weight of the user's torso is on the spine and pelvis. When the user is in a reclined position, the weight of the torso is distributed more evenly and over a broad area so that the force and pressure on the spine and the back muscles is lessened. Consequently, in a reclined configuration, the presence of enhanced lumbar support is not as important as when the sitter is in an upright position. Indeed, a pronounced lumbar support in a seat back may be found to be uncomfortable when the seat back is reclined. In those chairs in which a lumbar support is adjustable, it may be necessary for the user to manually adjust the configuration of the lumbar support when shifting between upright and reclined positions.

SUMMARY

The various aspects of the invention are embodied in chair mechanisms that include a frame having a seat portion and a back portion that extends upwardly from the back of the seat portion. The frame is rigid in use and may be defined by a pair of laterally spaced frame members secured to each other by frame crossbars. One embodiment of the chair mechanism includes a pair of elongate, flexible, resilient, ribbon-like profile bands that are mounted to the frame, each profile band extending downwardly along the back portion of one of the frame members. At least a portion of each profile band is maintained in longitudinal compression. The profile bands serve as support for the seat back that may be, for example, in the form of an elastic fabric or membrane that defines a back support surface spanning between and is attached along its edges to the profile bands. In other aspects of the invention, the seat back may be more rigid.

The profile (the shape as seen in side view) of the seat back may be varied by changing the profile of the profile bands, particularly along the portions of the bands that extend along the back portions of the frames. Changes in the profile of the bands cause corresponding changes in the profile of the back support surface that spans the region between the bands.

In some of the presently preferred embodiments the profile bands also may extend forwardly along the seat portion of the frame and may be attached to the front region of the seat portion of the frame. A seat cradle, adapted to support a seating surface, may be secured to the seat segments of the profile bands. Low-friction guides are provided at appropriate locations along the frame to engage with the flexible profile bands to facilitate their movement relative to the frame. The profile bands are configured to have a forwardly projecting curve in their back segments such that they will configure the chair back that spans between the flexible members to form a lumbar support. In this embodiment, as the user reclines, the seat cradle moves forward and that, in turn, straightens the lumbar curves of the flexible profile bands and, consequently, reduces the degree of lumbar support defined by the seat back that spans the profile bands.

The profile defined by the profile bands and, consequently, the back support surface between the bands, is controlled by varying the degree of longitudinal compressive forces applied to the profile bands. The profile bands are formed to a selected profile and are mounted on the frame to maintain a compressive force on the bands. Consequently, the bulge is applied to the chair back support surface between the bands and defines a variable lumbar support. Relaxing the degree of compression, applied to the profile band will reduce or eliminate the bulge, thus shifting the back profile to a more flattened profile with less lumbar support. The extent of compression is controlled in response to the position of the seat of the chair, as by the user shifting between upright and reclined positions. The seat portion of the chair is movable and is connected to the back profile bands to increase or decrease the degree of compression.

In another aspect of the invention, the chair mechanism enables a user to access, comfortably, a work surface, such as a desk, throughout the range of seat back positions, including upright and reclined positions. Thus the user can benefit from a reclined position in which much of the weight of the torso is shifted from the spine and pelvis to the chair while maintained the ability to reach the work surface comfortably as well as maintaining a comfortable eye-to-desk monitor level.

It is among the objects of the invention to provide reclinable chair mechanisms that avoid the use of heavy duty springs with high spring rates and linkages and pivots in order to change the configuration of the seating support surfaces of the chair.

Further objects of the invention are to provide a reclinable chair having a simple, low cost construction as well as good dwell characteristics.

Also among the objects of the invention to provide chair constructions in which the contour of the chair back adjusts automatically in response to adjustment in the posture of a person seated in the chair.

Another object of the invention is to provide a chair construction in which the degree of lumbar support increases as the user sits in a more upright or forward position and decreases when the user's posture is more reclined.

A further object of the invention is to provide an ergonomic chair in which the contour of the chair back is controlled by the forward-rearward position of the moveable chair seat.

DESCRIPTION OF THE DRAWINGS

The foregoing and other objects and advantages of the invention will be appreciated more fully from the following description, with reference to the accompanying drawings in which.

DESCRIPTION OF ILLUSTRATIVE EMBODIMENTS

Figure 1:
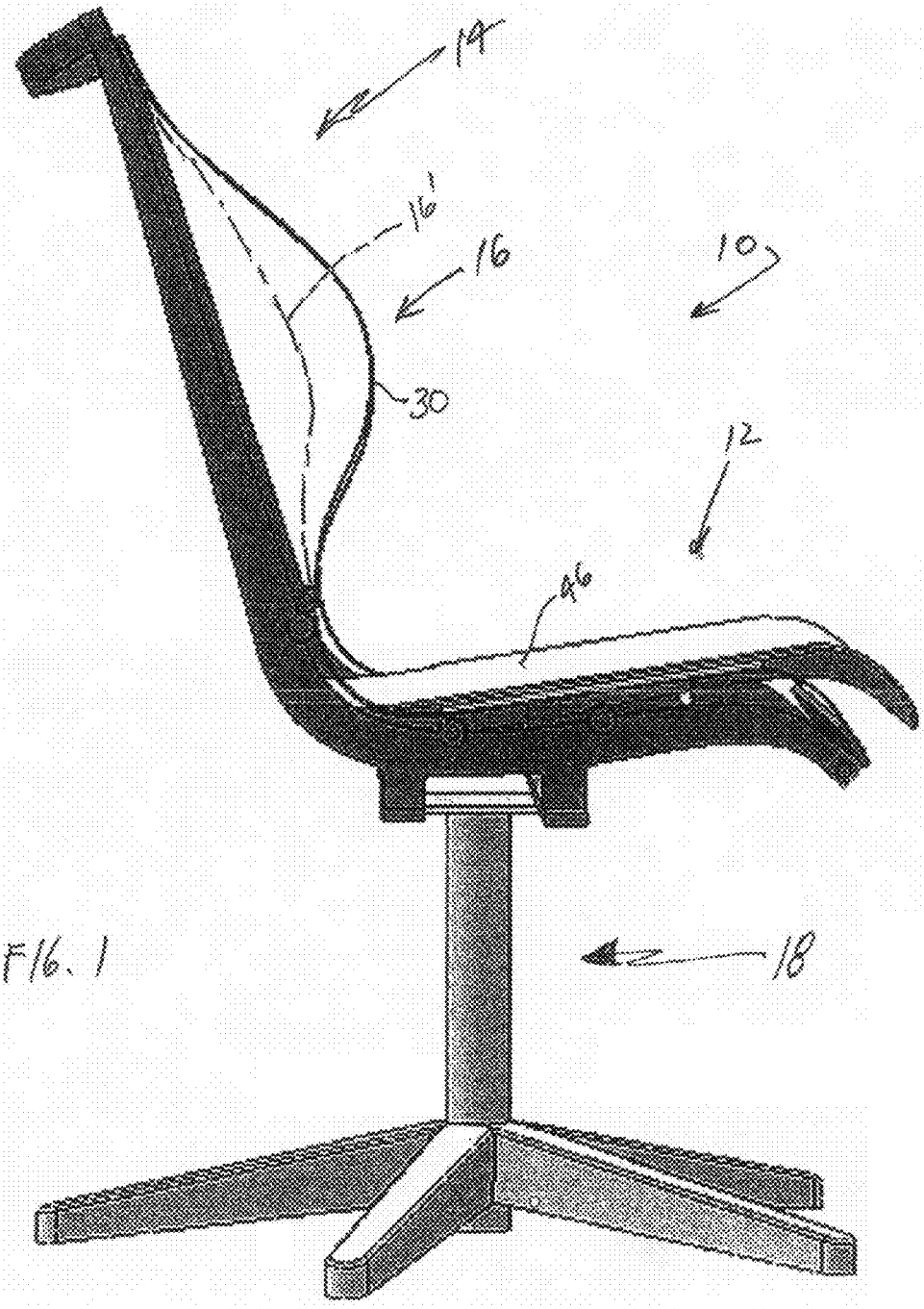
FIG. 1 is a side illustration of some of the elements of a task chair incorporating principles of the invention.

FIG. 1 illustrates, in side view, the mechanical aspects of an office or task chair 10 having a mechanism embodying principles of the invention. The chair has a seat region 12 and a back region 14 extending heightwise relative to the seat. As may be desirable in office chairs and other task chairs where long term support for the user's back is to be provided, the chair mechanism is configured to form a lumbar support defined by a forwardly projecting bulge 16 at a height that will cause the chair back to bear firmly, but comfortably, against the user's lumbar region. When the user sits in an upright position the lumbar support region 16 is effective to configure the chair back to support the lumbar region of the user. FIG. 1 shows, in solid, the degree of bulge 16 of profile bands 30 (described below) and, in phantom at 16', the profile of the seat back that extends, between the profile bands and actually contacts the user's back. As will be described, the invention enables the user to control the extent to which the lumbar support projects forwardly by controlling the profile of the profile bands. The profile of the bands is controlled by the user shifting his position on the chair. As used herein, the term "profile" refers to the shape of a chair component, such as the profile bands 30, as seen in side view. The term "contour" refers to the shape of the seat back as seen in plan and at a selected horizontal plane.

Figure 2:
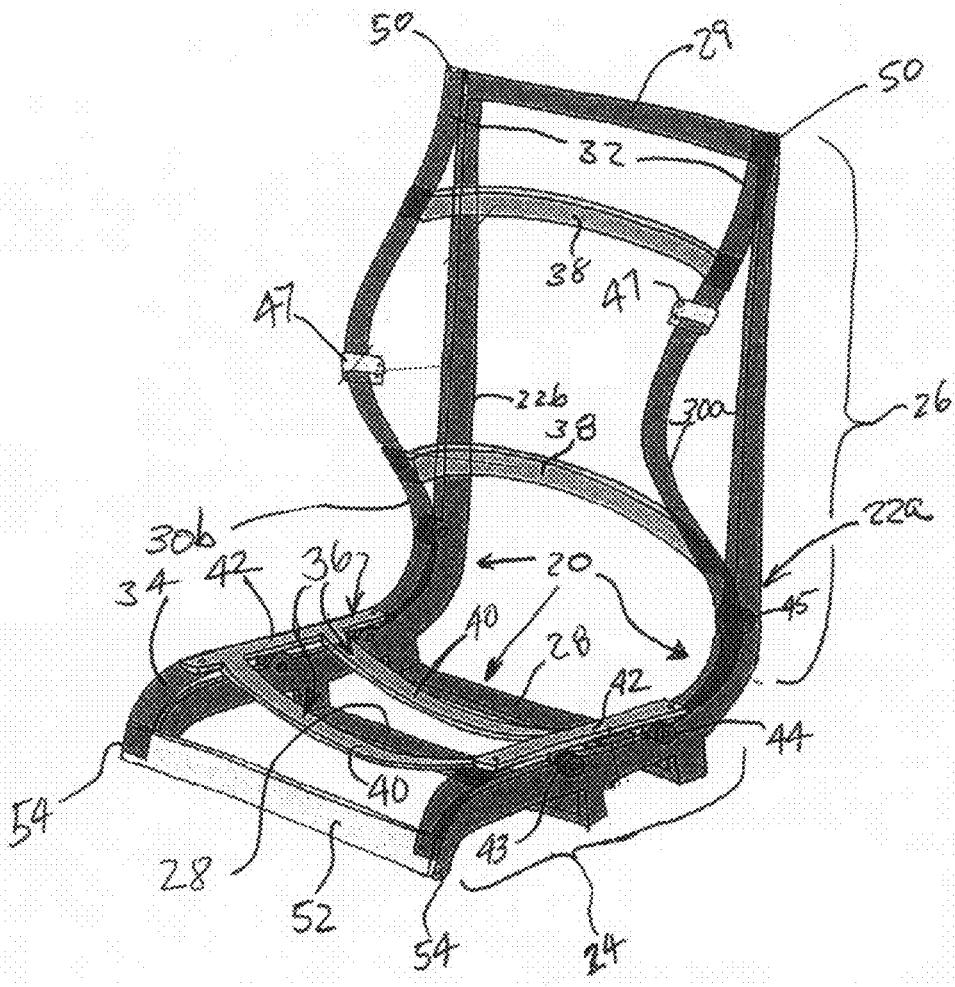
FIG. 2 illustrates one embodiment of a chair mechanism embodying principles of the invention.

FIG. 2 illustrates one embodiment of a chair mechanism of the present invention. The chair includes a frame assembly 20 that is rigid during use and is defined by a pair of laterally spaced frames 22*a*, 22*b*. Each frame may be considered as having a seat segment 24 and a connected back segment 26. The frames 22*a*, 22*b* are secured with respect to each other in a fixed, laterally spaced arrangement, as by lateral braces 28, 29 secured at their ends to the frames 22*a*, 22*b*. The seat and back segments 24, 26 may be formed from any of a variety of appropriately rigid materials including for example, wood, various metals, engineered materials and the like. The frames 22*a*, 22*b* may be formed in a one-piece configuration or may be made from two or more pieces joined securely to each other. The lateral braces 28 serve to rigidify the frame assembly 20 as well as to provide structure by which the chair mechanism may be mounted to chair legs or a chair base 18 (FIG. 1). By "rigid" it is meant that the seat and back segments 24, 26 are fixed relative to each other when the chair is in use, that is, when a person is sitting in the chair. The seat and back segments 24, 26 could be connected to enable adjustment in their angles, as long as they can be locked in a selected fixed position. The term "rigid" is intended to cover both constructions.

The chair mechanism of FIG. 2 includes a pair of elongate, longitudinally flexible, ribbon-like, profile bands 30*a*, 30*b*, each band being associated with one of the frames 22*a*, 22*b*. The profile bands 30*a*, 30*b* have the ability to flex to define varying profiles by which the shape of the back of the chair can be controlled. The bands may be formed in a variety of constructions such as from a suitable spring steel or various engineered materials or composites. In the FIG. 2 embodiment, the length of each profile band 30 is greater than the combined lengths of the seat and back segments 24, 26 of its associated frame 22 to enable a portion of the profile band to be formed to define a bulge. The profile bands in this embodiment may be considered as having a back end 32 and a seat end 34. The back end 32 of the profile band 30 is attached to the upper portion of the back segment 26 of its associated frame 22 and the seat end 34 of the band 30 is attached at the forward region of the seat segment 24 of its associated frame 22. As described in further detail below, the laterally spaced profile bands 30 are adapted to support seating and back support surfaces that span the profile bands to support the user, with the user being disposed between the bands 30. The bulging segments 16 of the profile bands configure the back supporting surface to define a lumbar support region. In order to maintain the spacing of the profile bands 30, rigid lateral braces 38 may be attached at their ends to the profile bands, as shown.

Figure 2A:
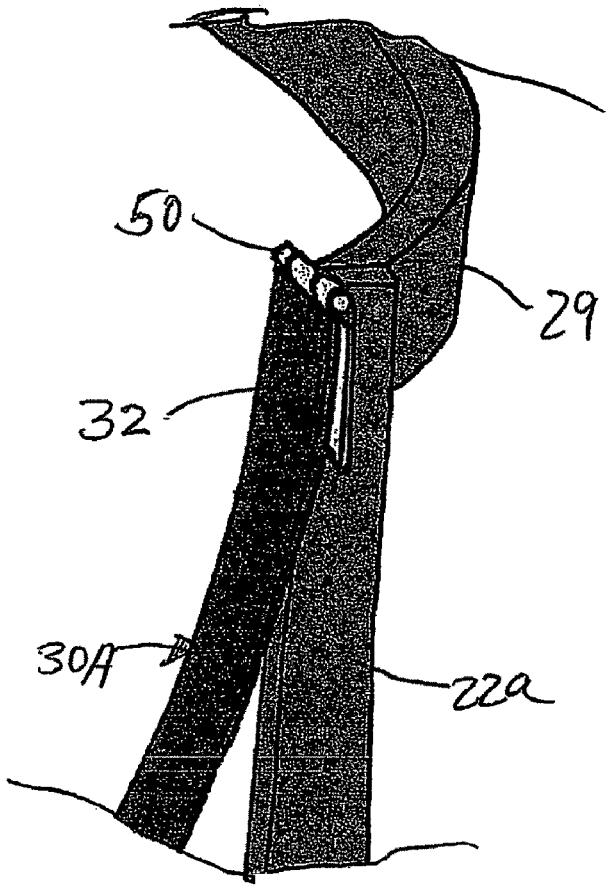
FIG. 2A is an enlarged illustration of the upper region of one of the frames and illustrating a hinged connection to the upper end of a profile band.

In the embodiment of the chair mechanism shown in FIG. 2, the ends 32 of the profile bands 30*a*, 30*b* are attached at an upper region of the frame back segments 26. Each of the profile bands 30*a*, 30*b* is formed to a profile so that when attached to the frame, the bands will define the bulging region. As described below, the bands are formed so that when they are in their relaxed configuration, unattached to the frame, they have a slight bias that will cause a portion of the back to bulge forwardly when that portion of the band is compressed. The end portions 32 of the profile bands may be attached at hinge points 50 as suggested in FIG. 2A in order to reduce repeated bending stresses on those portions of the profile members 30.

The seat segments of the profile bands also are provided with a bracing arrangement in the form of a seat cradle 36 that includes transversely extending seat braces 40. The braces 40 may be secured to reinforcements 42 that together define the seat cradle. The cradle 36 is secured to the seat segments of the members 30. The reinforcements 42 serve also to rigidify the portions of band seat segments to prevent them from bending.

Figure 2B:
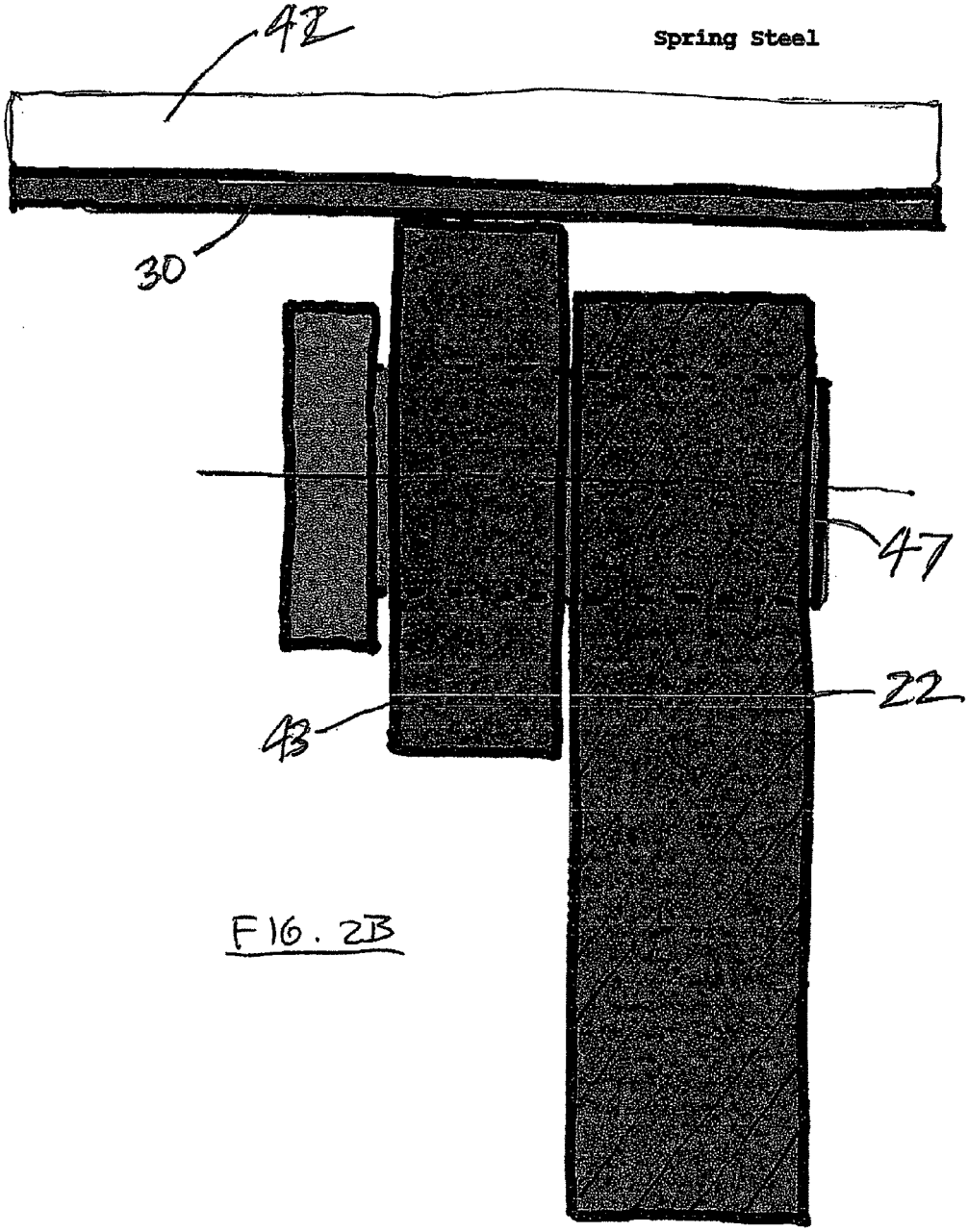
FIG. 2B is an enlarged sectional illustration of one of the rollers.

Each of the profile bands is supported for shifting longitudinal movement along the general plane of its associated frame. To that end, each of the frames is provided with a low friction device that enables the seat segments of the profile band to move easily in a forward or rearward direction. In the embodiment illustrated in FIG. 2, the low friction device may take the form of a plurality of rollers 43, 44, 45 mounted at selected locations along the frames 22 to support the members 30. FIG. 2B illustrates, diagrammatically, a representative arrangement of one of the rollers as seen along the line 2*b*-2*b* of FIG. 2. The roller, such as roller 43, is rotatably mounted on an axle 47 that, in turn, is securely mounted to a portion of the frame 22. The roller 43 is positioned to support the profile band 30. Other low friction devices, such as low friction polymeric strips (e.g., polytetrafluoroethylene or Delrin) may be employed. FIG. 2D illustrates one embodiment of a low friction device in the form of a low friction polymeric element 49 that may be mounted, as by fasteners 51 to positions of the frames.

Figure 2C:
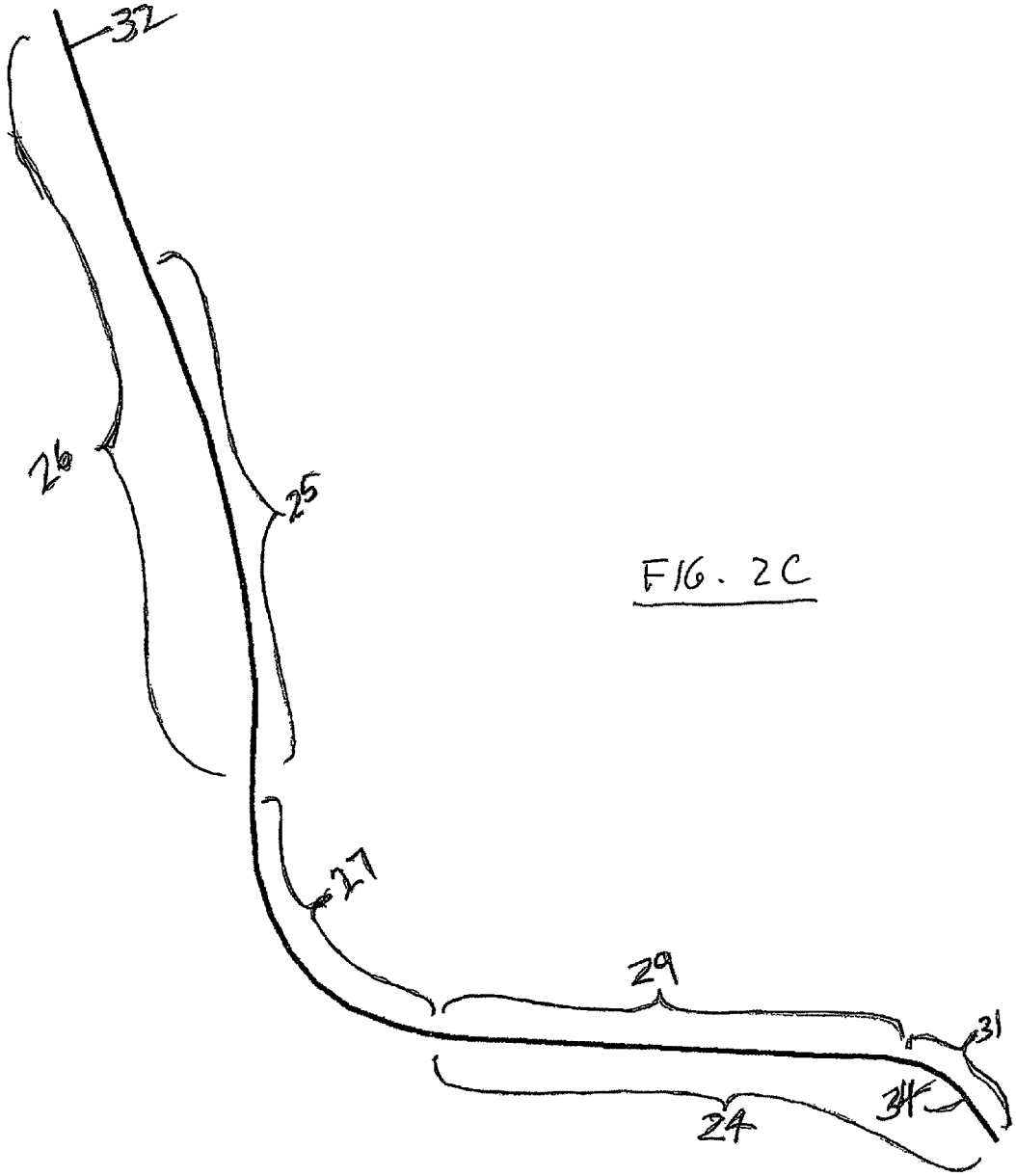
FIG. 2C is an illustration of one embodiment of an unstressed, unattached profile band as seen from the side and before attachment to a chair frame.
Figure 2D:
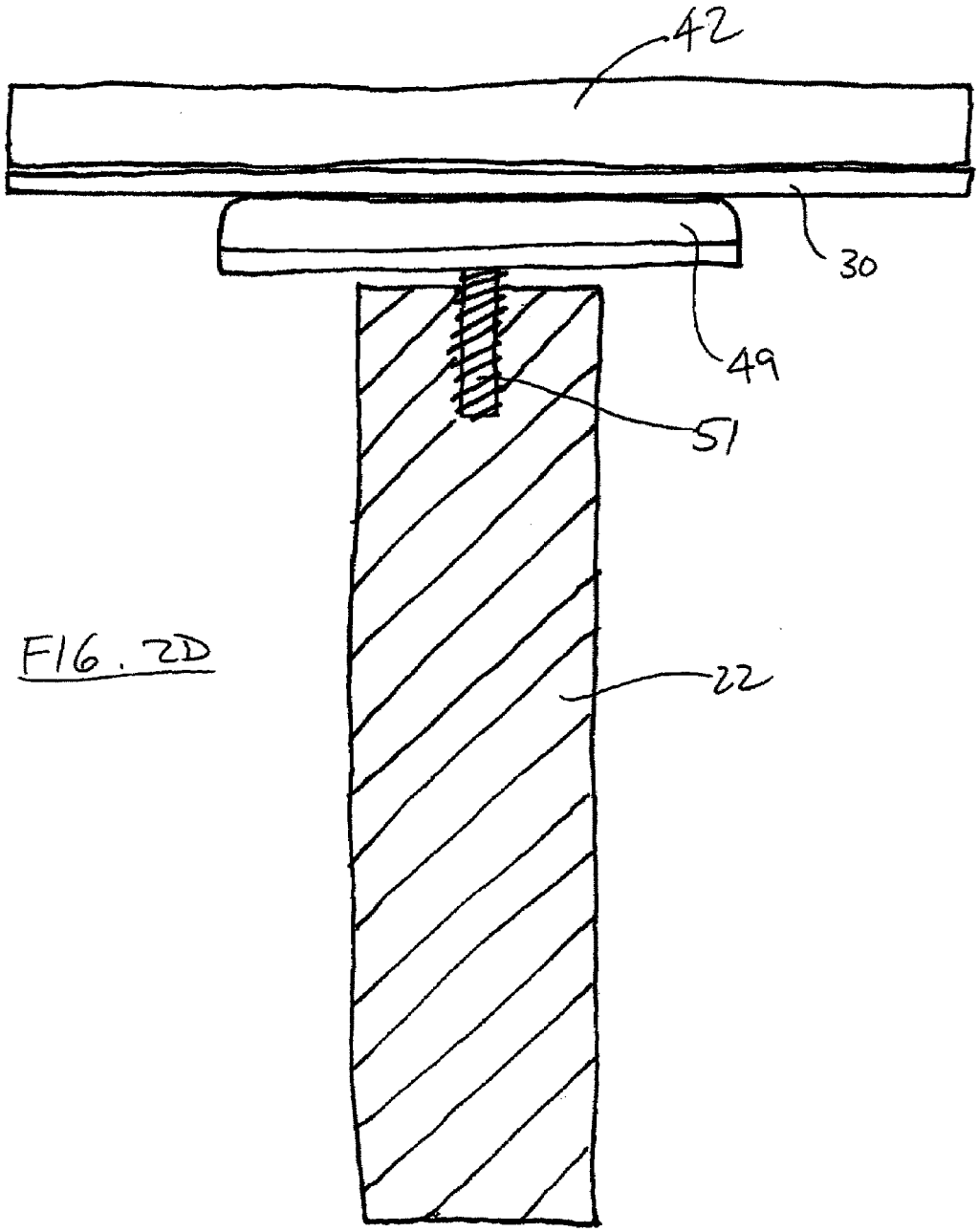
FIG. 2D is a sectional illustration of another type of low friction element that may be used as an alternate to the arrangement of rollers of FIGS. 2 and 2B.

FIG. 2C illustrates an exemplary profile for a profile band 30 as used in the embodiment of FIG. 2. The band 30 may be formed from blue-tempered polished spring steel, 1.5 inches wide and about 0.33 inches thick, available from MacMaster-Carr under Part No. 9075k28. It should be understood that other dimensions and materials, including engineered materials, may be employed. The lower region 25 of the back section 26 of the profile band is formed to define a slight forwardly projecting bulge such that when the back segment 26 is subjected to a longitudinal compressive force, the region 25 will bulge forwardly to define the lumbar bulge 16. The profile band also is formed to include a concave (as seen from the front) transition section 27 where the back segment 26 transitions into a substantially straight seat segment 29. Thus, the profile band in this aspect of the invention, may be considered as having back and seat segments that are joined at a transition and in which the back segment includes a lumbar segment that curves in one direction and a transition region that curves in the opposite direction.

In the illustration of FIG. 2C, the forward-most segment 31 of the profile band is curved downwardly to define the forward end 34 of the band 30. The arrangement of the profile band is such that when the upper end 32 is secured to the upper portion of the frame and the lower, forward end 34 is secured, as by attachment to the hinge bar 52, at least that portion of the profile band 30 in the lumbar region will be in compression along its length. The term "compression" is intended to refer to a force applied to at least a portion of the length of the profile band to cause that portion of the band to bulge, the degree of the bulge corresponding to the magnitude of the force. That compression causes the lumbar segment 25 to bulge forwardly, defining the lumbar bulge 16 and also causes the curved transition region 27 to be urged rearwardly toward and into the corresponding transition region of the frame so that it is maintained in place by the resilience of the band. In the embodiment of FIG. 2, the transition region 27 is effectively pressed into engagement with and between the rollers 44, 45. Thus, when the profile bands are mounted, they are in a pre-stressed, compressed configuration.

Among the benefits of the invention is the comparative ease with which the user can shift between reclining and upright positions. The omission of heavy springs, typical of prior art task chairs, and the low forces required to shift the configuration of the profile bands results in a mechanism having good dwell characteristics.

Figure 3:
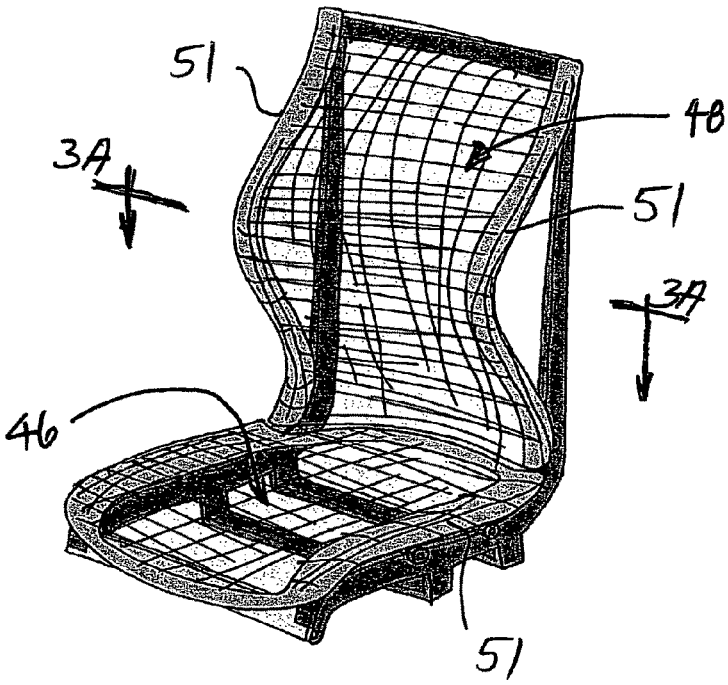
FIG. 3 is an illustration of a chair incorporating principles of the invention in which the chair seat and back are formed from fabric or a membrane stretched between and attached to the flexible profile bands.

FIG. 3 illustrates the chair mechanism shown in FIG. 2 with the seat and back of the chair having a seating surface 46 and a back support surface 48 attached to and spanning the region between the profile bands 30*a*, 30*b*. The seat and back surfaces 46, 48 may take any of a wide variety of forms as will be familiar to those in chair design. Preferably, the back support surface 48 is somewhat elastic and compliant as to stretch, resiliently to conform partially, to the contour of the user's torso. For example, the surface 48, as suggested in FIG. 3, may take the form of a woven or knitted fabric or fabric-like membrane attached along its edges to the profile bands 30*a*, 30*b*. The membrane may be attached by clips 47, as suggested in FIG. 2, or by forming band-receptive sleeves 51 along the edges of the seat and back surfaces 46, 48. In the embodiment shown in FIGS. 2 and 3, the back surface 48 should be sufficiently flexible and compliant so that as the profile bands assume varying profiles, the contour of the back surface will conform to a shape as desired for the particular posture desired by the user.

Figure 3A:
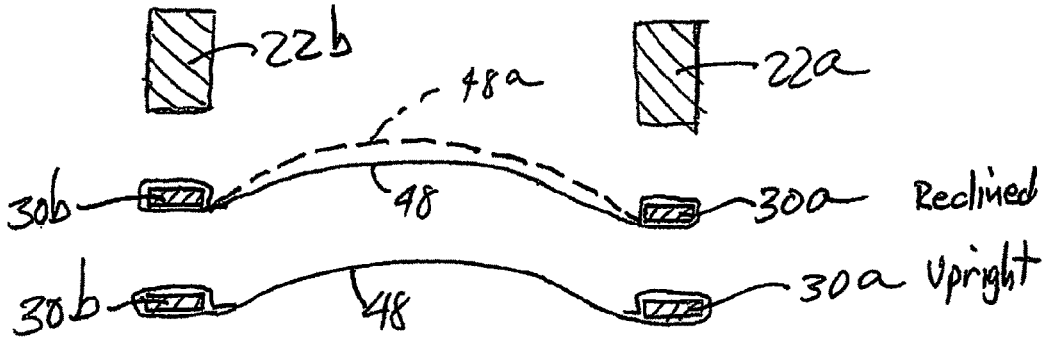
FIG. 3A is a diagrammatic sectional, plan, illustration as seen along the plane 3A-3A of FIG. 3 and illustrating the back portion of the chair in its upright and reclined positions.

FIG. 3A is a diagrammatic sectional, plan view of the contour of the back support surface 48 in its upright and reclined positions as seen along the line 3A-3A of FIG. 3. In its upright position, the bulged region of the profile bands 30*a*, 30*b* are in a more forwardly projected configuration and the back support is located in a more forwardly spaced position from the frames 22*a*, 22*b*. In the reclined position, the bulge is less pronounced or may be eliminated and the profile bands 30*a*, 30*b* as well as the back support surface 48 are closer to the frames 22*a*, 22*b*. The back support may be formed from an elastic or other compliant material so that in the reclined position it may assume a deeper contour, as suggested in phantom at 48*a*, as the back support surface supports an increased load of the user's torso.

The degree to which the lumbar support region of the profile bands and back surface 48 support the user's lumbar region may be controlled by the forward-rearward position of the seat segment 24 of the profile bands. Thus, in the embodiment of FIG. 2, one may shift from an upright position to a reclined position by leaning back and allowing or urging the seat cradle and seat segment 24 of the profile bands to shift forwardly. That causes the height of the bulge to reduce and, in turn, reduces the degree of lumbar support as the sitter assumes a more reclined position. In the embodiment of FIG. 2, two of the rollers 43, 44 support directly the weight of the sitter, while the third roller 45 is located to avoid friction between the profile bands and their associated frame members in the transition region between the seat and back segments 24, 26 of the bands and associated frames.

In order to take up the forward movement of the forward ends 34 of the profile bands, those ends may be attached to the fronts of the seat segments 24 of the frames 22 in a manner that permits forward-rearward movement of the seat. This may take the form of an arrangement as shown in FIG. 2 in which a hinge bar 52 is hinged, at pivots 54, to the front ends of the seat segments 24 of the frames 22. The forward ends of the profile bands 30 may be curved forwardly and downwardly over the front portion of the seat and may be attached securely to the hinge bar 52. As the seat portion of the chair moves forwardly and rearwardly, the hinge bar may pivot so that the forward ends of the profile bands may shift to accommodate the seat motion.

Figure 4A:
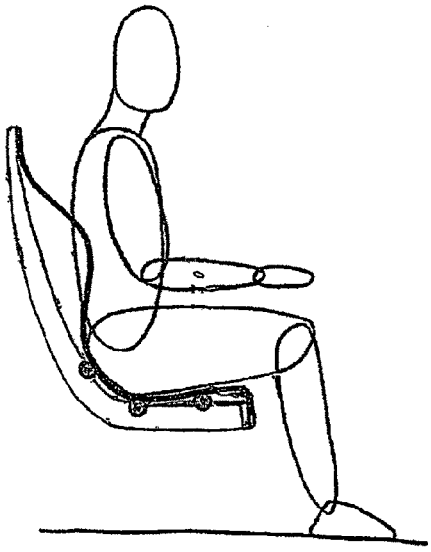
FIGS. 4A and 4B illustrate, in diagrammatic side view, a chair mechanism of the type as shown in FIG. 2 and showing the configuration of the mechanism with a user seated in upright and reclined positions, respectively.
Figure 4B:
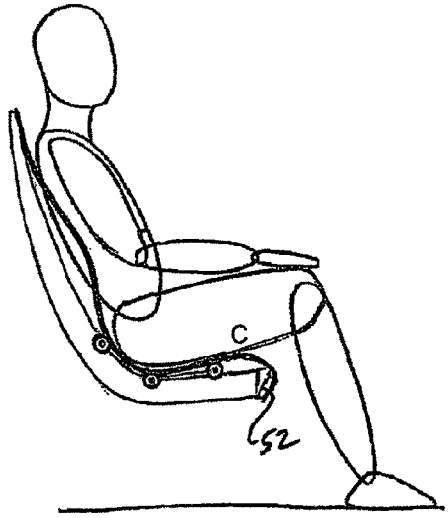

FIGS. 4A and 4B illustrate the operation of the chair mechanism of FIG. 2 as a sitter shifts between an upright and a reclined position. In the upright position, the seat is in its rear position such that the lumbar bulge of the profile bands is pronounced and maintain the chair back membrane in a position to provide good lumbar support. FIG. 4B illustrates the sitter having shifted to a reclined position in which the seat has moved forwardly somewhat with the hinge bar 52 having pivoted forwardly and with the lumbar bulge being reduced. The motion between upright and reclined positions is very smooth and easy with the present invention and requires low, relatively constant force by the user throughout the range of motion.

Figure 5C:
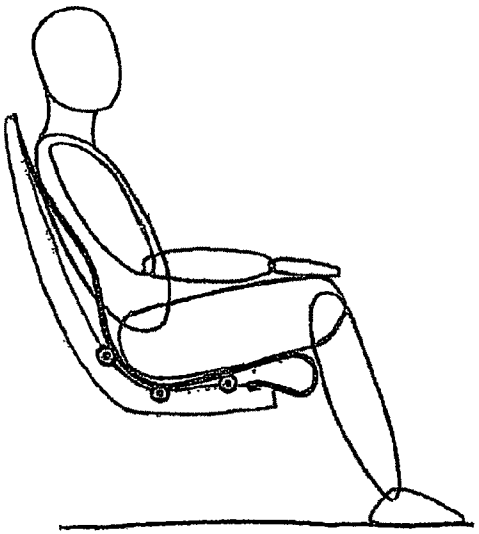
FIGS. 5A-5C illustrate, diagrammatically a side view of a modified chair mechanism incorporating principles of the invention with the mechanism in its resting position, with a user seated upright in the chair and with the user reclined in the chair, respectively.
Figure 5B:
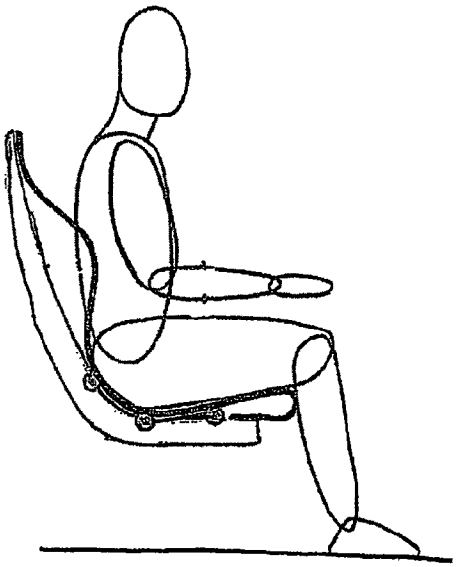
Figure 5A:
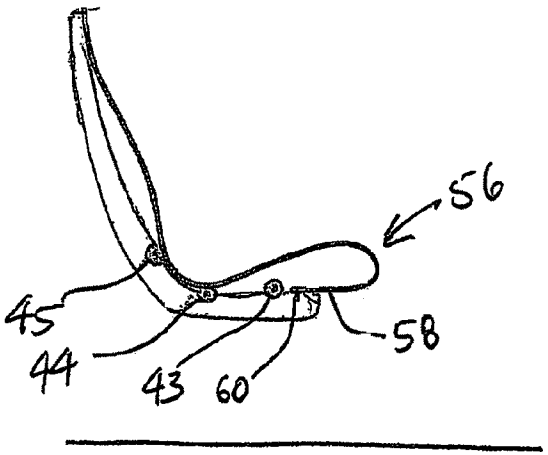

FIGS. 5A-5C illustrate, in side diagrammatic view, a modified embodiment of the chair mechanism. As shown in FIG. 5A, the profile bands, at their forward ends are formed to define a loop 56 with a reverted end 58 that is attached to the front of the seat segment 24 of the frame 22, as at 60. In its rest position (FIG. 5A) it may be seen that the profile band has a relatively small lumbar bulge and a portion of the seat segment of the profile band is spaced above one of the roller bearings 43. When the user sits in the chair (FIG. 5B), his weight compresses the loop 56 and causes the profile band to shift rearwardly. The rearward shifting of the profile band applies a compressive longitudinal force to the back segment of the profile band, causing the lumbar bulge to project forwardly to provide firm lumbar support when the user is sitting in an upright position. The user may shift to a reclining position (FIG. 5C) by leaning back to open the angle between his torso and thigh during which the seat portion of the profile bands shifts forwardly and the back portion shifts to a more straightened configuration with reduction in the degree of lumbar support. During this movement, the loop 56 enlarges or decreases between the upright and reclined positions.

Figure 6:
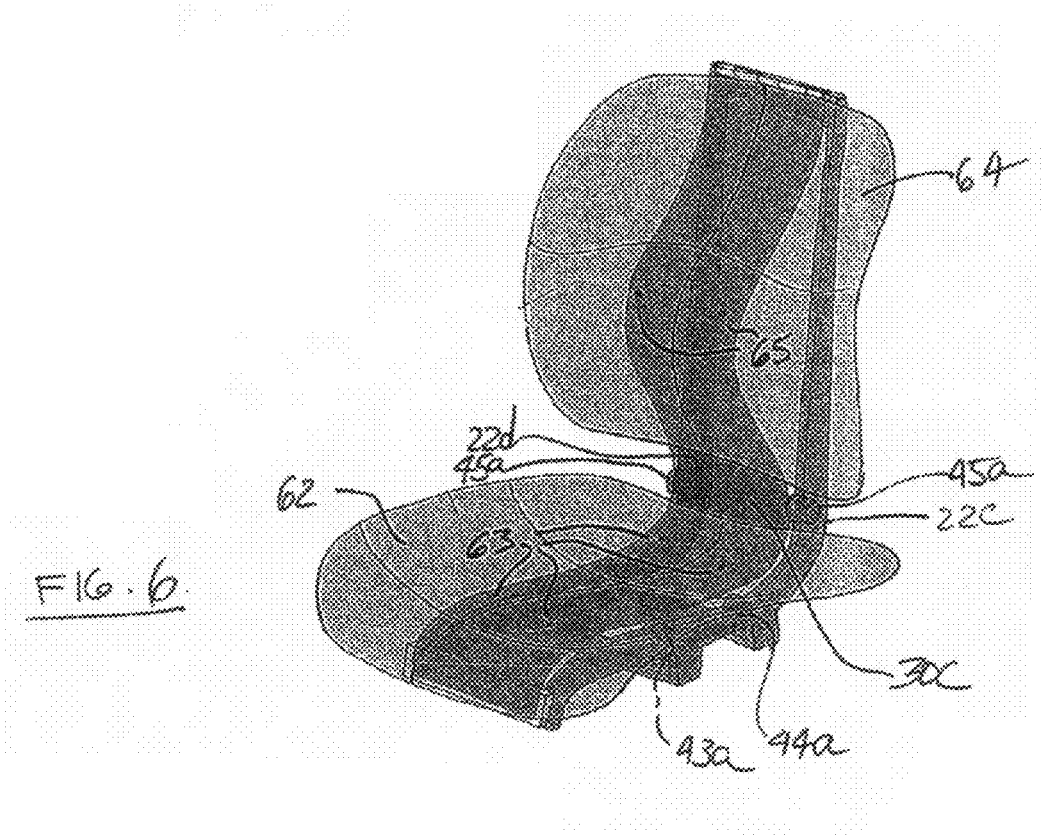
FIG. 6 is an illustration of another embodiment of the invention incorporating principles of the invention.
Figure 6B:
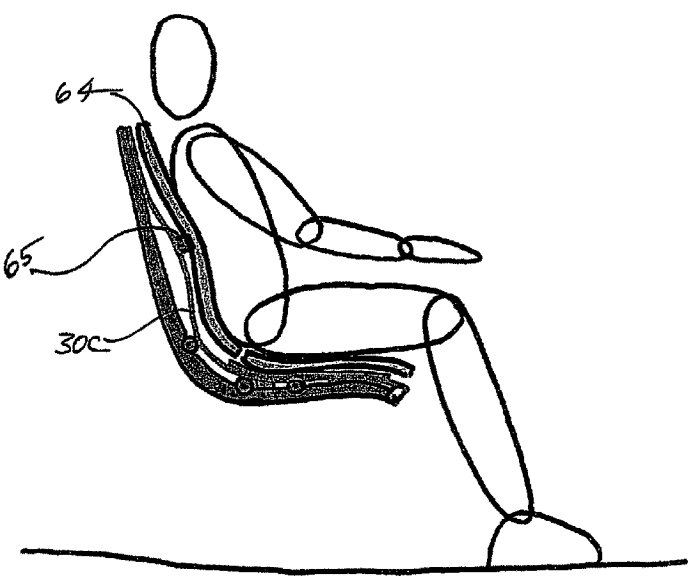
FIGS. 6A and 6B illustrate, in diagrammatic side view, a chair mechanism as shown in FIG. 6 with a user seated in the chair in upright and reclined positions, respectively.
Figure 6A:
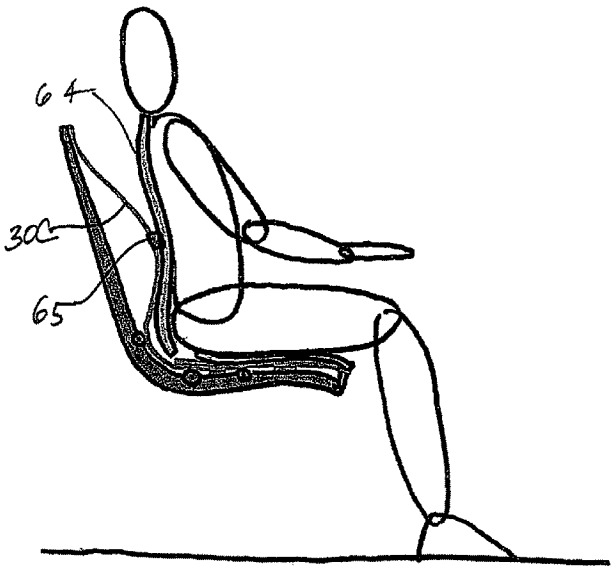

FIG. 6 illustrates another embodiment in which a single, relatively wide, profile band may be employed. In this embodiment, the frames 22*c*, 22*d* may be constructed and connected to each other in the same manner as described above in connection with the embodiment of FIG. 2. In this embodiment, however, the frames 22*c*, 22*d* are closer together and a single wide profile band 30*c* spans the width defined by the frames 22*c*, 22*d*. The frames 22*c*, 22*d* similarly are supported by rollers 43*a*, 44*a*, 45*a* or other low friction elements to facilitate and guide movement of the profile band 30*c* with respect to the frame 22. As shown in FIG. 6, this embodiment may be provided with separate seat and back supporting surfaces. In this embodiment, the seat 62 and back 64 may be rigid or have relatively little compliance. The seat may be attached at several locations to the profile band 30*c*, as at fasteners 63. The back 64 is attached securely to the back segment of the profile band 30*c* at a portion of the lumbar bulge of the profile band 30*c* such as at fasteners 65. The connection between the seat back 64 and profile band 30*c* is such that the seat back 64 can flex about a horizontal axis in opposition to the resistance of the profile band 30*c*. This arrangement enables the rigid back 64 to pivot against the resilient force of the profile band 30*c* to accommodate itself to the attitude of the user's back while providing support along substantially the full height of the user's back, particularly when the user is seated in an upright position (FIG. 6A). When seated in an upright position (FIG. 6A) the increased lumbar bulge defined by the profile bands provides support along the user's back including the lumbar region. FIG. 6B illustrates the configuration of this embodiment when the user is reclined. The seat member 62 has moved forwardly, lessening the compression on the profile band 30*c* with a resulting reduction in the height of the profile bulge. Thus, the back 64 shifts rearwardly to a more reclined position and has the ability to pivot slightly about a horizontal axis defined approximately at the connection of the back 64 to the profile band 30*c*, to accommodate the user.

Figure 7C:
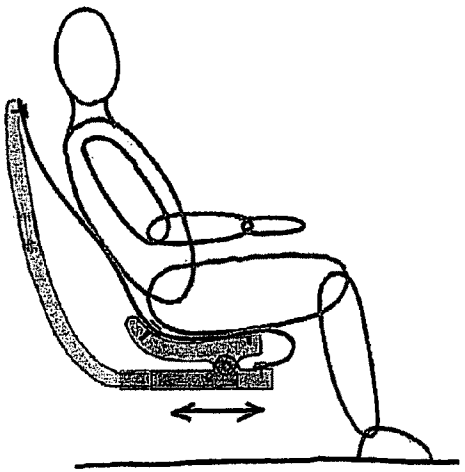
FIGS. 7A-7C illustrate, diagrammatically and in side view, another embodiment of a chair mechanism incorporating principles of the invention with the mechanism in its resting position, with the user seated upright in the chair and with the user reclined in the chair, respectively.
Figure 7B:
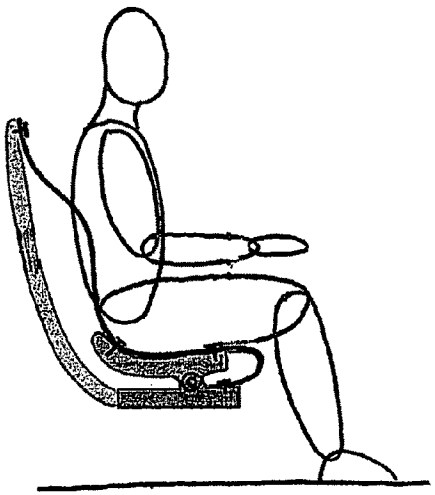
Figure 7A:
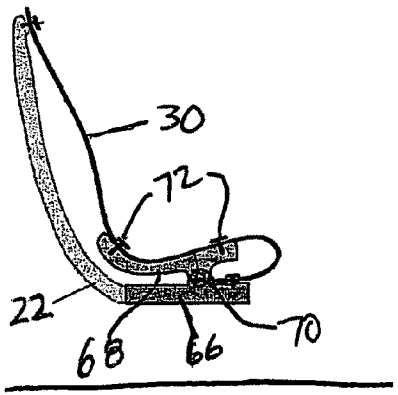

FIGS. 7A-7C illustrate another embodiment of the invention in which the chair mechanism is shown in three positions including its rest position, with a sitter in the chair in an upright position and with the sitter in a reclined position, respectively. In this embodiment, the profile bands 30 are similar to those discussed above in connection with the embodiment of FIGS. 5A-5C in that the upper end of the back is attached at a fixed location to the upper portion of the frame 22. The forward ends of the profile bands, instead of being attached at a fixed location on the seat portion of the frame, are, in turn, secured to a seat cradle 66 that is mounted to the seat segment of the frame so that it can move forwardly and rearwardly (FIG. 7C). The seat cradle 66 supports a seat 68 that is pivotally mounted at a pivot 70 enabling the seat 68 to rock slightly forward (clockwise in FIGS. 7A and 7B) and rearward (counterclockwise in FIG. 7C) about the pivot. The profile bands 30 are attached to the seat 68, as at attachment points 72 so that the seat segment of the band 30 moves together with the seat 68, pivotally as well as in a forward-rearward direction.

FIG. 7B illustrates the functioning of this embodiment. When the user sits in the chair, the weight causes the seat structure to pivot about pivot 70 to accommodate the desired posture of the sitter. Should the sitter wish to be in an upright position (FIG. 7B), the seat 68 may pivot forwardly, causing the loop to compress and the lumbar bulge to project forwardly to provide lumbar support in the upright position. Should the user wish to recline (FIG. 7C), the seat cradle 66 is free to advance forwardly while the seat 68 pivots rearwardly, those motions serving to lessen the compression on the back segment of the profile bands to reduce the extent of lumbar bulge and, therefore, lumbar support.

Figure 8C:
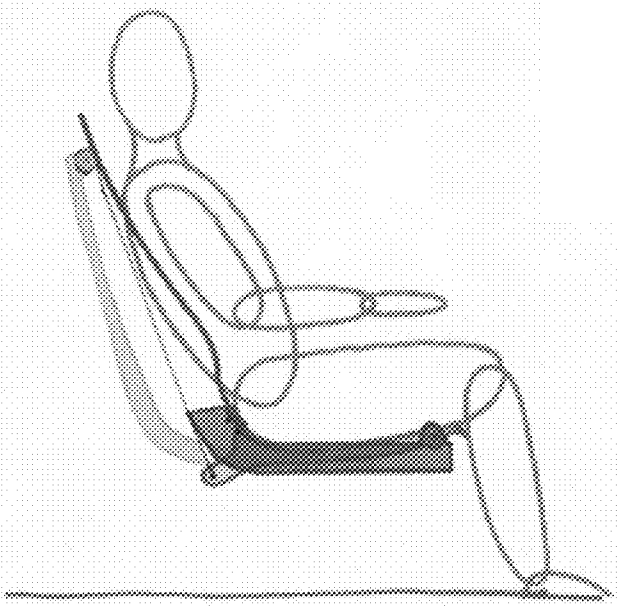
FIGS. 8A-8C illustrate, diagrammatically and in side view, a chair mechanism incorporating principles of the invention with the mechanism in its resting position, with the user seated upright in the chair and with the user reclined in the chair, respectively.
Figure 8B:
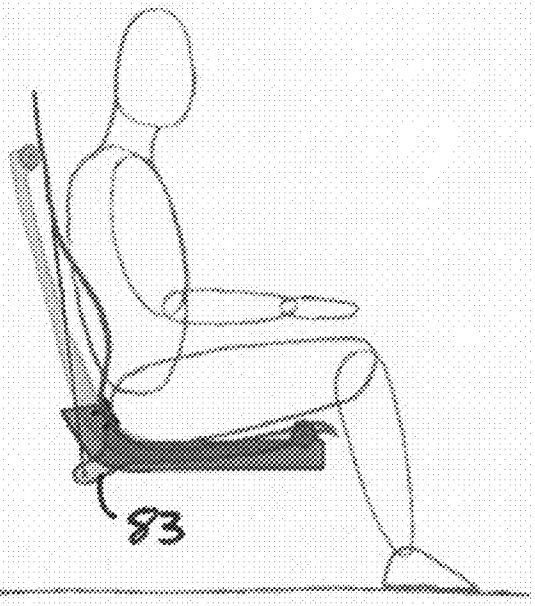
Figure 8A:
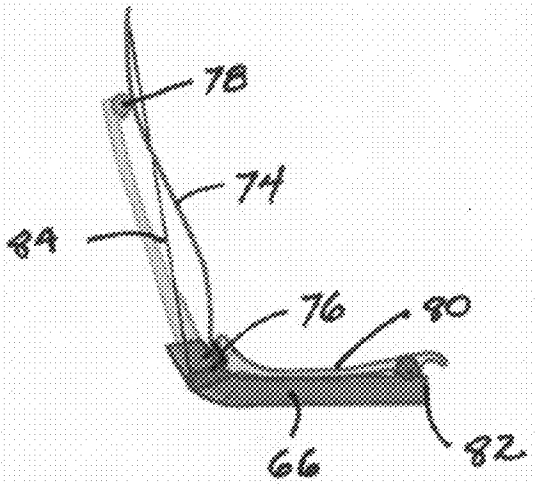

FIGS. 8A-8C illustrate, in diagrammatic side view, another embodiment of a chair mechanism showing the mechanism in a rest position, an upright seated position and a reclined position, respectively. In this embodiment, the profile band 74 extends from the rear portion of the seat cradle 66 where it is attached at a fixed location 76. The upper end of the profile band 74 is engaged with a guide, such as a roller element 78 or other low friction arrangement. The profile band 74 is formed so that when it is compressed along its length, a portion in the lumbar region will form a lumbar bulge (FIG. 8B) to support the user's lumbar region when the user is seated in an upright position (FIG. 8B). The profile band 74 is compressed by an arrangement that includes a seat 80 that is pivoted, at 82, to the seat cradle 66. The seat cradle 66 is movable with respect to the frame in the same manner as the embodiment discussed above in connection with the FIG. 7 embodiment. The rear portion of the seat 80 has a rearward extension 83 and is connected, as by a tension cable 84, to an upper part of the profile band. When the user sits in the seat, his weight depresses the seat, tensioning the cable 84 and applying an increased compression force to the profile band 74 (FIG. 8B). Should the user wish to assume a reclined position, the seat cradle 66 can be urged forwardly (FIG. 8C). The forward movement of the seat cradle reduces the compression on the profile band and, consequently, reduces the height of the lumbar bulge.

Figure 9:
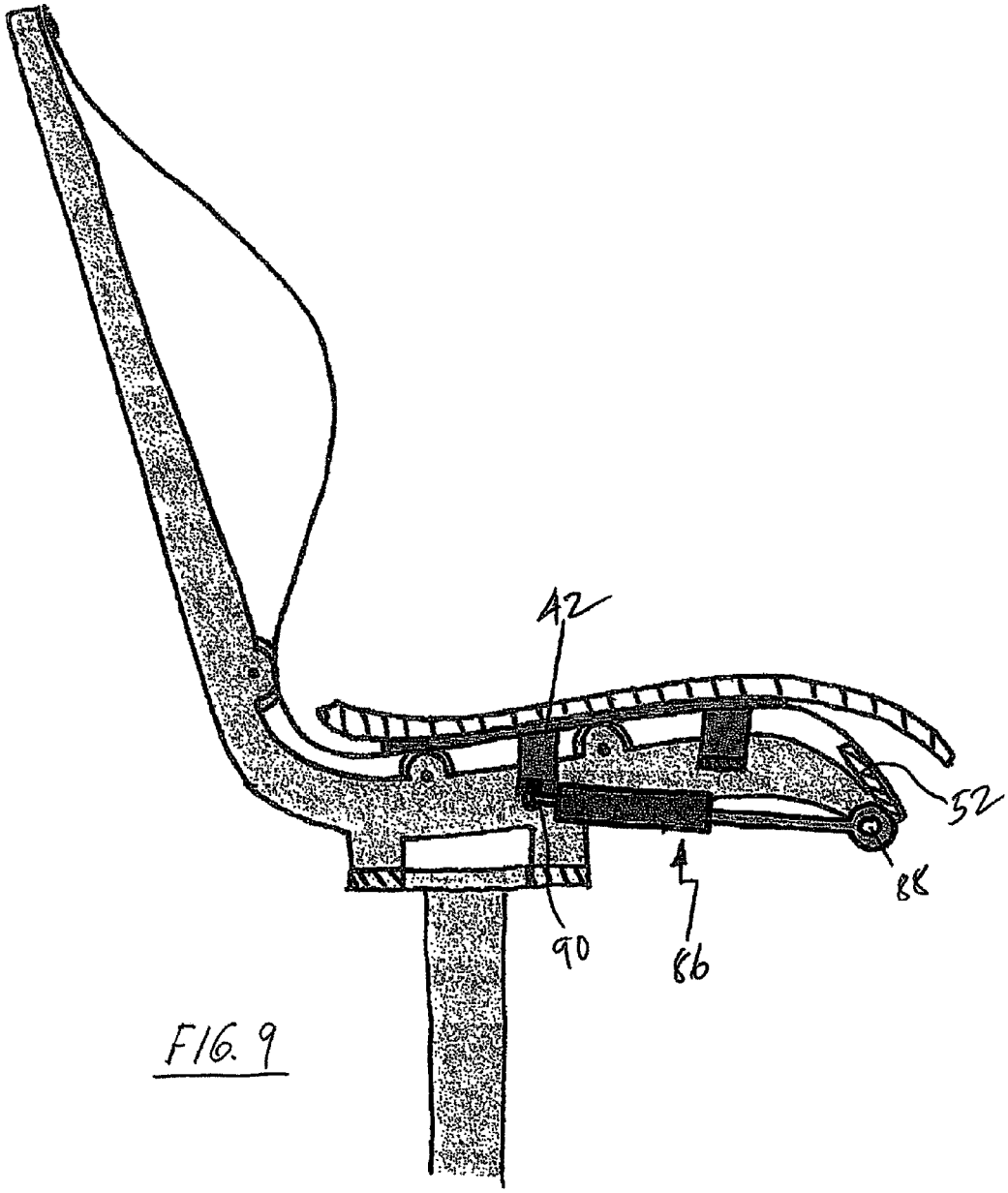
FIG. 9 is a diagrammatic side view of a chair mechanism provided with a light force applying device arranged to bias the profile member to cause the lumbar portion of the profile member to bulge forwardly.

FIG. 9 illustrates, diagrammatically, a modification in which a light spring force may be incorporated to bias the seat in its rearward position with the profile bands oriented in their maximum lumbar-supporting configuration. In some instances, depending on the particular design of a chair embodying the invention, it may be found that the forward-rearward motion of the seat and consequent change in the lumbar bulge requires too little force by the user. By providing a bias of the seat toward its rearward position, the degree of resistance to seat movement may be controlled to a comfortable level. As shown in FIG. 9, this may be accomplished by providing a spring mechanism, such as an air cylinder spring 86 pivoted at one end 88 to the front of the frame and at its other end 90 to a portion of the seat or seat cradle, such as at the reinforcement bar 42. The biasing force should be relatively low, no more than an order of magnitude of about twenty pounds, or at least not so great as to adversely affect the dwell characteristics of the mechanism.

Figure 10:
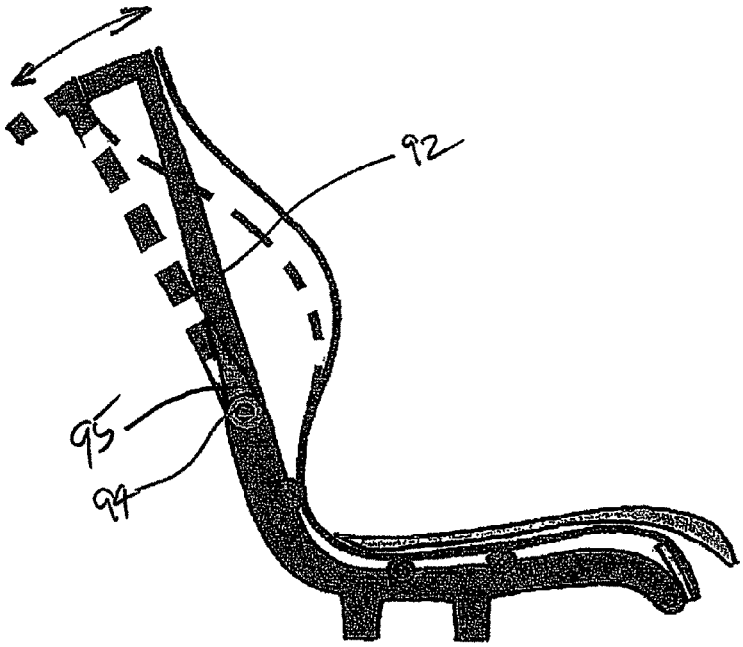
FIG. 10 is a diagrammatic side view of a chair mechanism in accordance with the invention in which the angular position of the back portion of the frame members can be adjusted angularly and then locked in a selected rigid angular position.

FIG. 10 shows a modified embodiment of a chair mechanism, such as of the mechanism described in connection with FIG. 2, in which the rearward tilt of the back portion of the frame may be adjusted to different fixed positions. In this embodiment, the back portion of the frame is articulated and includes a back frame segment 92 that is pivotally connected at 94 to a portion of the frame at or above the transition portion of the frame. The pivot 94 includes an arrangement by which the orientation of the back frame segment 92 can be fixed in position and may, for example, be in the form of a rotatable handle or knob 95 that operates a screw clamp to selectively release or lock the back frame segment. Such devices are well known to those in the art and are common, for example, in automobile seating. FIG. 10 illustrates, in solid, the configuration of the back frame segment 92 and the profile band in its forward-most, upright position and in phantom in the reclined position. With the angle of the back frame segment 92 fixed and locked, the operation of the device is the same as that described above.

Figure 11B:
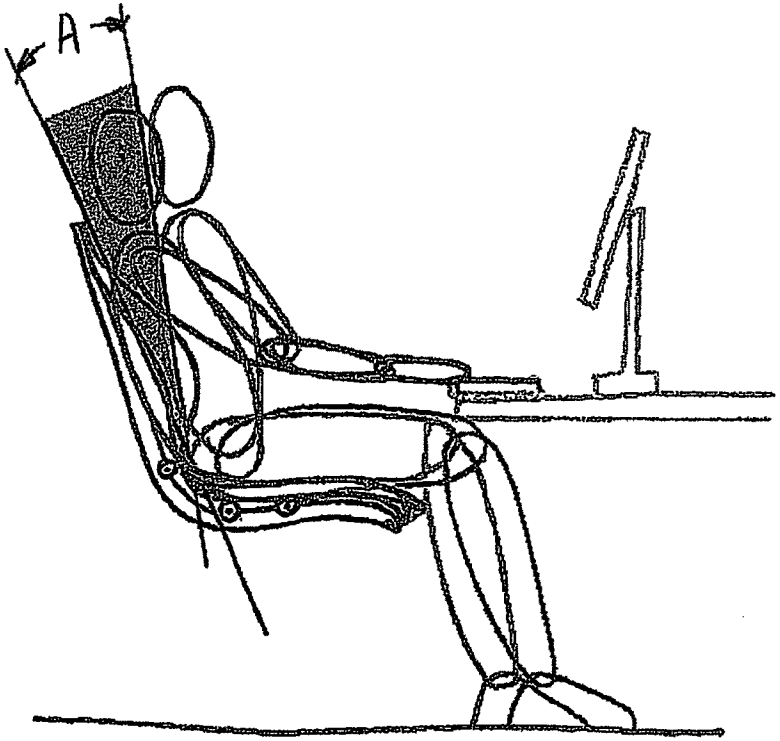
FIGS. 11A and 11B illustrated, diagrammatically and respectively, the range of movement between upright and reclining positions for a prior art task chair (FIG. 11A) and a task chair with a limited range of movement between upright and reclined positions (FIG. 11B).
Figure 11A:
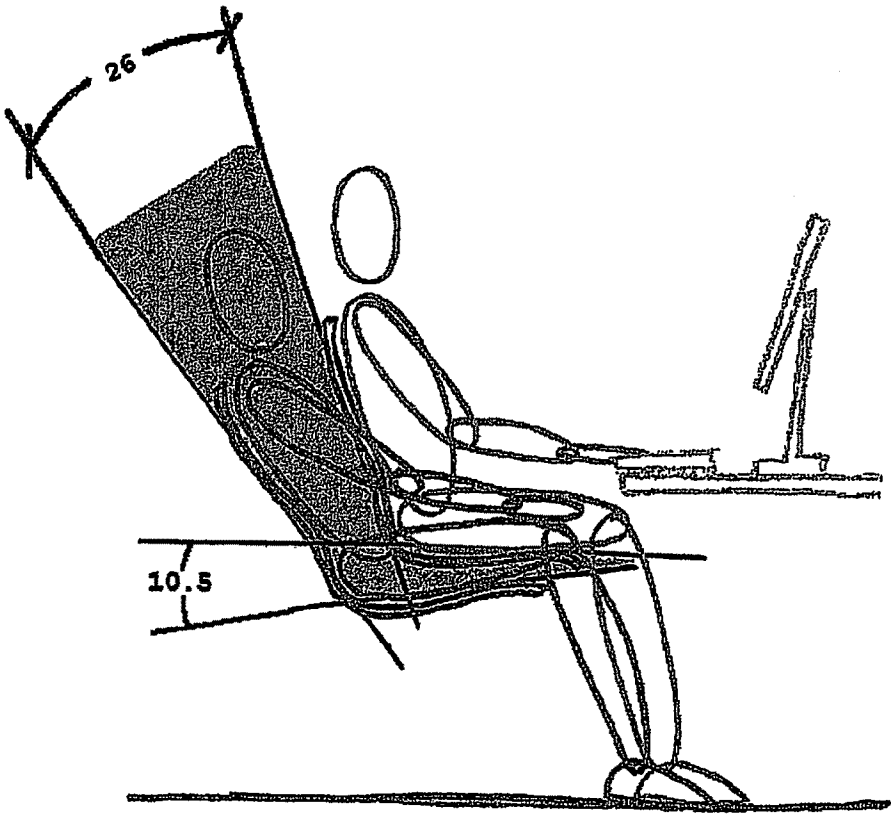
FIG. 11A (PRIOR ART)

FIGS. 11A and 11B respectively illustrate the comparative recline range of a prior art task chair and the recline range of a chair embodying one aspect of the present invention. The prior art chair has a recline range with an angle of the order of 26 degrees for the back of the chair with a rearward tilt angle for the seat of about 10.5 degrees. As illustrated, diagrammatically, in FIG. 11A, the user can reach, the work surface when in an upright position and the user's eye-to-monitor height is at the user's desired position. In recline, however, it is more difficult for the user to reach the work surface or keyboard. Additionally, the position of the user's eye with respect to the monitor has dropped and may present additional difficulties. In contrast, the present invention, illustrated in FIG. 11B has a shorter range of back tilt, indicated at angle A. Preferably, this angle is not substantially greater than about 20 degrees and, preferably, is closer to 17 degrees. Additionally, it should be noted that the seat in the present invention moves generally horizontally and does not include a rearward tilting motion. Consequently, the user can reach the work surface or keyboard both in upright and reclined positions and with less lowering of the eye position with respect to the monitor.

It should be understood that the foregoing description of the invention is intended to be merely illustrative.

We claim:

1. A chair comprising:

a frame assembly having a seat segment and a back segment;

at least one elongate, flexible, resilient, profile band mounted to the frame at at least one fixed location on the frame and having a back segment extending along the back segment of the frame, each profile band having a lumbar portion adapted to bulge forwardly at the level of the lumbar region;

a seat assembly movably mounted relative to the frame;

the seat assembly being connected to the profile band to apply a variable compressive force to at least a portion of the profile band along its elongate direction and in response to seat assembly movement whereby the degree of bulge of the lumbar region of each profile band is controllable in response to the position of the seat assembly.

2. A chair as defined in claim 1 wherein the each profile band is connected directly to the seat assembly.

3. A chair as defined in claim 2 wherein each profile band has a forward end that is attached with respect to the frame to permit a portion of each forward end to flex as the seat assembly is moved in a forward direction.

4. A chair as defined in claim 3 wherein the forward end of each profile band is formed to define a resilient reverted bow and where the forward end of each profile band is secured to the frame.

5. A chair as defined in claim 2 wherein the seat assembly and profile bands are configured such that forward movement of the seat assembly causes a reduction the extent of the lumbar bulge.

6. A chair as defined in claim 1 wherein each profile band is connected indirectly to the seat assembly.

7. A chair as defined in claim 1 wherein the seat assembly is movable in a forward-rearward direction.

8. A chair as defined in claim 7 wherein the seat assembly is movable on a low friction support.

9. A chair as defined in claim 8 wherein the low friction support comprises rollers mounted to the frame.

10. A chair as defined in claim 8 wherein the low friction support comprises at least one member formed from a lubricious material mounted to the frame for slidable engagement with the underside of the profile band.

11. A chair as defined in claim 7 wherein an upright position of the chair is defined with the seat assembly in a rearward position and the lumbar bulge of each profile band is extended to its most forward position and a reclined position is defined in which the seat assembly is in its forward-most position and the degree of lumbar bulge of each profile band is less than that of the upright position;

the range of recline between the upright and reclined positions being no greater than about twenty degrees.

12. A chair comprising:

a frame assembly having a seat segment and a back segment, the frame assembly including a pair of spaced frame members;

a pair of elongate, flexible, resilient, profile bands, each mounted at a fixed location on the frame and having a back segment extending along the back segment of the frame and a seat segment integrally associated with the back segment, each profile band being associated with a frame member, each profile band having a lumbar portion adapted to bulge forwardly at the level of the lumbar region;

a seat assembly movably mounted relative to the frame;

the seat assembly being connected to each of the profile bands to apply a variable compressive force to at least a portion of the profile band in response to seat assembly movement whereby the degree of bulge of the lumbar region of the profile bands is controllable in response to the position of the seat assembly; and at least one transverse bracing member connected to the profile bands to maintain the lateral spacing of the profile bands substantially uniform along the length of the profile bands.

13. A chair as defined in claim 12 further comprising a seat cradle mounted to and spanning between the seat segments of the profile bands.

14. A chair as defined in claim 13 wherein the seat cradle pivots to enable the rear portion of the seat cradle to move in a heightwise direction;

the rear portion of the seat cradle being operatively connected to the back segment of the profile band to vary the compression applied to the profile band in response to heightwise movement of the seat.

15. A chair as defined in claim 14 wherein the seat cradle is mounted for forward-rearward movement relative to the frame to vary the compression on the profile band.

16. A chair as defined in claim 13 further comprising the seat cradle having a pair of reinforcing members extending in a forward-rearward direction and being spaced from each other, the cradle being attached to the seat segment of each profile band and being sufficiently rigid to maintain the seat segments of each profile band in a substantially coplanar relation.

17. A chair as defined in claim 12 further comprising:

low friction supports between the frames and their associated profile bands.

18. A chair as defined in claim 17 wherein the low friction support comprises rollers.

19. A chair as defined in claim 17 wherein the low friction element comprises a low friction slide.

20. A chair as defined in claim 12 further comprising a back support surface attached to the spaced profile bands and spanning the distance between the profile bands.

21. A chair as defined in claim 20 wherein the back support surface is sufficiently flexible to enable its contour to be varied correspondingly with the variation in shape of the back segments of the profile bands.

22. A chair as defined in claim 12 wherein the profile bands are formed from a unitary, one-piece spring element that includes the back segment and the seat segment.

23. A chair as defined in claim 12 wherein each profile band includes a transition region between the lumbar segment and the seat segment, the lumbar segment and transition region curving in opposite directions.

24. A chair as defined in claim 12 further comprising:

a seat back membrane attached to and spanning between the profile bands to provide a support surface for the user, at least the back portion of the support surface having an elasticity sufficient to yieldably support the torso of a user, the forwardly bulging portion of the profile bands maintaining the seat back support surface in a profile that defines a lumbar support for the user.

25. A chair as defined in claim 24 wherein the seat back surface is defined by a compliant woven or knitted fabric.

26. A chair as defined in claim 1 further comprising:

a relatively rigid seat back attached securely to each profile band at a connection adjacent the middle of the forward bulge of the profile band, each profile band having sufficient flexibility and elasticity so that the seat back can resiliently pivot about a generally horizontal axis in opposition to a restoring force of each resilient profile band.

27. A chair comprising:

a frame assembly having a seat segment and back segment;

at least one elongate, flexible, resilient, profile band mounted to the back segment of the frame, each profile band having a lumbar portion adapted to bulge forwardly;

a seat assembly movable relative to the frame;

means responsive to movement of the seat assembly for controlling the extent to which the lumbar portion of each profile band bulges;

means for applying a compressive load to each profile band and wherein the means for varying the degree of forward bulge of each lumbar portion comprises means for varying the compressive load on each profile band.

* * * * *